US008070012B2

(12) United States Patent
Alvares et al.

(10) Patent No.: US 8,070,012 B2
(45) Date of Patent: Dec. 6, 2011

(54) CAN CLOSURE ARRANGEMENT

(75) Inventors: Antonio Carlos Teixeira Alvares, Sao Paulo (BR); Antonio Roberto Sene, Sao Paulo (BR)

(73) Assignee: Brasilata S/A Embalagens Metalicas, Sao Paulo-SP (BR)

( * ) Notice: Subject to any disclaimer, the term of this patent is extended or adjusted under 35 U.S.C. 154(b) by 187 days.

(21) Appl. No.: 12/445,623

(22) PCT Filed: Aug. 18, 2007

(86) PCT No.: PCT/BR2007/000277

§ 371 (c)(1),
(2), (4) Date: Apr. 15, 2009

(87) PCT Pub. No.: WO2008/046170

PCT Pub. Date: Apr. 24, 2008

(65) Prior Publication Data

US 2010/0288784 A1 Nov. 18, 2010

(30) Foreign Application Priority Data

Oct. 20, 2006 (BR) ..... 0604684

(51) Int. Cl.
*B65D 41/16* (2006.01)
*B65D 41/18* (2006.01)

(52) U.S. Cl. ..... 220/780; 220/611; 220/617

(58) Field of Classification Search ..... 220/359.1, 220/610, 611, 617–620, 780, 792, 795
See application file for complete search history.

(56) References Cited

U.S. PATENT DOCUMENTS

| | | | | |
|---|---|---|---|---|
| 1,969,524 | A * | 8/1934 | Rollason | 292/256.6 |
| 2,019,376 | A | 10/1935 | Wilhelm | |
| 3,333,728 | A * | 8/1967 | Burdick, Jr. | 220/792 |
| 4,796,771 | A | 1/1989 | Stettler et al. | |
| 6,119,890 | A * | 9/2000 | Kawamata | 220/695 |
| 6,523,713 | B1 * | 2/2003 | Helms | 220/831 |
| 7,703,626 | B2 * | 4/2010 | Witt | 220/276 |

FOREIGN PATENT DOCUMENTS

| | | |
|---|---|---|
| EP | 1688360 | 8/2006 |
| FR | 2456668 | 12/1980 |
| GB | 471119 | 8/1937 |

* cited by examiner

*Primary Examiner* — Harry Grosso
(74) *Attorney, Agent, or Firm* — Fish & Richardson P.C.

(57) ABSTRACT

A closure arrangement for cans and pots comprising a tubular body having a side wall whose upper edge defines a seat for a lid. The upper edge comprises a peripheral annular flange carrying, in a free outer edge, a continuous rib with a cross-section contour comprising two opposite circle arc portions, with curvature centers disposed in the same plane orthogonal to the axis of the tubular body, the lid being inferiorly provided with a continuous circumferential groove to be seated against the respective circle arc portions of the continuous rib, so as to axially lock the lid in the tubular body. An annular gasket is carried by one of the parts of peripheral annular flange and lid, to be pressed by the other of said parts upon closing the lid.

12 Claims, 6 Drawing Sheets

CAN CLOSURE ARRANGEMENT

This application is a US National Phase Application under 35 U.S.C. §371 of International Patent Application No. PCT/BR2007/000277 filed Aug. 18, 2007, which claims priority to and the benefit of Brazilian Patent Application No. PI0604684-3, filed Oct. 20, 2006, each of which are hereby incorporated by reference in their entireties. The International Application published as WO 2008/046170 A1 on Apr. 24, 2008.

FIELD OF THE INVENTION

The present invention refers to an arrangement to provide the closure of cans of the type comprising a tubular body presenting an upper edge which forms a seat onto which is seated and retained a manually removable plastic lid.

PRIOR ART

The prior art related to the present subject-matter provides different can closure arrangements, which have been developed to mainly guarantee the hermeticity of the container to be closed, as well as the possibility of the container being easily reclosed by the user during the progressive consumption of products stored in the interior of said container.

These hermetic closure arrangements are generally defined in metallic cans by using of a lid whose opening requires the help of any tool in the form of a lever. In another known arrangement, the closure of the lid is made over different pots made of plastic or glass and the retention of the lid is guaranteed by additional retaining elements that are incorporated to the structure of the pot or of the lid.

In one of these solutions, the inconvenience results not from the constructive complexity, but from a lever being required for enabling the user to open the container.

In the other solution, while the use of an additional tool for removing the lid is not required, the constructive arrangement requires additional means, generally of complex construction and which substantially raise the price of the end product, in order to affix the lid to the container.

In other well known arrangements, the lid is seated and retained onto the upper edge of the container by fitting with a slight elastic deformation, so as to guarantee a reliable retention of the lid on the container. However, these arrangements, which are widely utilized in plastic containers, do not guarantee an adequate tightness of the lid-container mutual fitting, thus being only utilized for provisionally storing different products, particularly food articles, in a relatively short storage phase, during the process of consuming the content of said containers.

Aiming at minimizing the prior art inconveniences, a closure arrangement object of patent application PI 0200891-2 has been proposed by the same applicant and which provides a can having an upper edge in the form of a continuous rib with its cross-section defined by at least one circle arc portion, as well as a lid, usually in plastic material, provided with a continuous circumferential groove presenting an upper annular wall to be seated onto the continuous rib, and an inner circumferential wall, against which is seated the circle arc portion of the continuous rib.

Although guaranteeing a good tightness and a reliable axial retention of the lid, the closure arrangement cited above still presents aspects that need to be improved.

In this previous solution, the axial retention of the lid is guaranteed only by the interference between the inner wall of the circumferential groove of the lid and a respective radially internal circle arc portion of the continuous rib. However, this fitting is particularly adequate to guarantee tightness and axial retention of the lid only in the applications in which the lid is submitted to forces, such as inner pressure in the container, which tend to displace said lid axially outwardly from its seat in the can. In the cases in which the can is internally submitted to a negative pressure until the occurrence of the first opening of the lid, the previous solution commented above does not ensure a tight closure during long shelf periods.

It should also be noted that it is further desirable, in many cases, to increase the closure tightness degree, by providing a sealing annular gasket, carried by the continuous rib of the upper edge of the can or by the circumferential groove of the lid and that is usually made of plastic material, such as plastisol.

Although said gaskets increase the closure tightness degree, they actuate directly between the lid and the seat (rib) onto which is seated and axially retained the upper edge of the can, requiring special cares and complex application to avoid interference with the axial retaining arrangement of the lid and usually conducting to an undesired level of waste as a result of retention and tightness deficiencies in the closure.

SUMMARY OF THE INVENTION

The object of the present invention is to provide a closure arrangement for metallic cans that are internally submitted to a positive or negative pressure, which permits simultaneously obtaining, through a simple construction of relatively low cost, a high tightness degree in the can closure, an easy opening and a reclosure of the lid through simple operations which do not require additional means or tools, as well as a reliable axial retention of the lid in the closed condition.

It is a further object of the invention to provide a closure arrangement as cited above, which contains a tamper-evident means for evidencing the first opening of the lid.

As already mentioned above, the present closure arrangement is applied to cans of the type which comprises a tubular body, presenting an upper edge which defines a seat for the seating and retention of a lid in plastic material and which is manually removable from its closing position on the tubular body.

According to the invention, the upper edge of the tubular body is constructed so as to comprise a peripheral annular flange which projects radially outwardly from the tubular body, being internally incorporated to the latter and carrying, in a free outer edge, a continuous rib projecting upwardly from the peripheral annular flange and which presents a cross-section contour comprising two opposite circle arc portions with their curvature centers disposed in the same plane orthogonal to the axis of the tubular body.

The lid, on its turn, is inferiorly provided with a continuous circumferential groove which comprises an upper annular wall portion to be seated onto the continuous rib, and inner and outer wall portions to be seated, by elastic deformation of at least one of the parts of continuous rib and lid, against the respective circle arc portions of the continuous rib, above and below said plane, so as to axially lock the lid of the tubular body.

The present closure arrangement further comprises a sealing gasket carried by one of the parts of peripheral annular flange and lid and which is pressed by the other of said parts upon closing the lid.

In a preferred construction, the lid further carries, peripherally and inferiorly through a plurality of breakable bridges, a seal strip which is manually broken by the user upon the first opening of the lid, said seal strip being generally positioned in an upper region of the tubular body which presents a cross-section contour that is reduced in relation to the remainder of the body, so as to maintain said seal strip inside the larger contour of the tubular body and thereby protected from undesired impacts during the handling and shipping operations of the cans.

The construction of the continuous circumferential groove under the lid, which cooperates both externally and internally with respective circle arc portions of the continuous rib of the upper edge of the tubular body, permits the lid to be reliably and axially locked in said continuous rib, in conditions in which said lid is submitted to inner pressures or axial forces to pull it outwardly from the body, as well as in conditions in which said lid is submitted to axial forces to push it to the interior of the can, which occurs when the product is stored under negative pressure conditions, to be thus maintained during the entire long shelf period, before the first opening thereof.

The provision of the annular gasket between the lid and the peripheral annular flange of the tubular body allows said gasket to be constructed aiming exclusively to guarantee a high degree of sealing tightness, without the constructive project of the gasket interfering with the constructive project of the continuous rib and of the continuous circumferential groove of the lid, for achieving the adequate axial locking of the latter.

Hence, the constructive solution proposed herein aims to guarantee a high degree of reliability regarding the mechanical retention of the lid to the can, as well as a high degree of tightness obtained not only before the first opening of the lid, but also subsequently, during the successive reclosures thereof, during the progressive consumption of the stored product.

BRIEF DESCRIPTION OF THE DRAWINGS

The invention will be described below, with reference to the enclosed drawings, given by way of example of possible embodiments of the invention and in which.

DETAILED DESCRIPTION OF THE INVENTION

Figure 1:
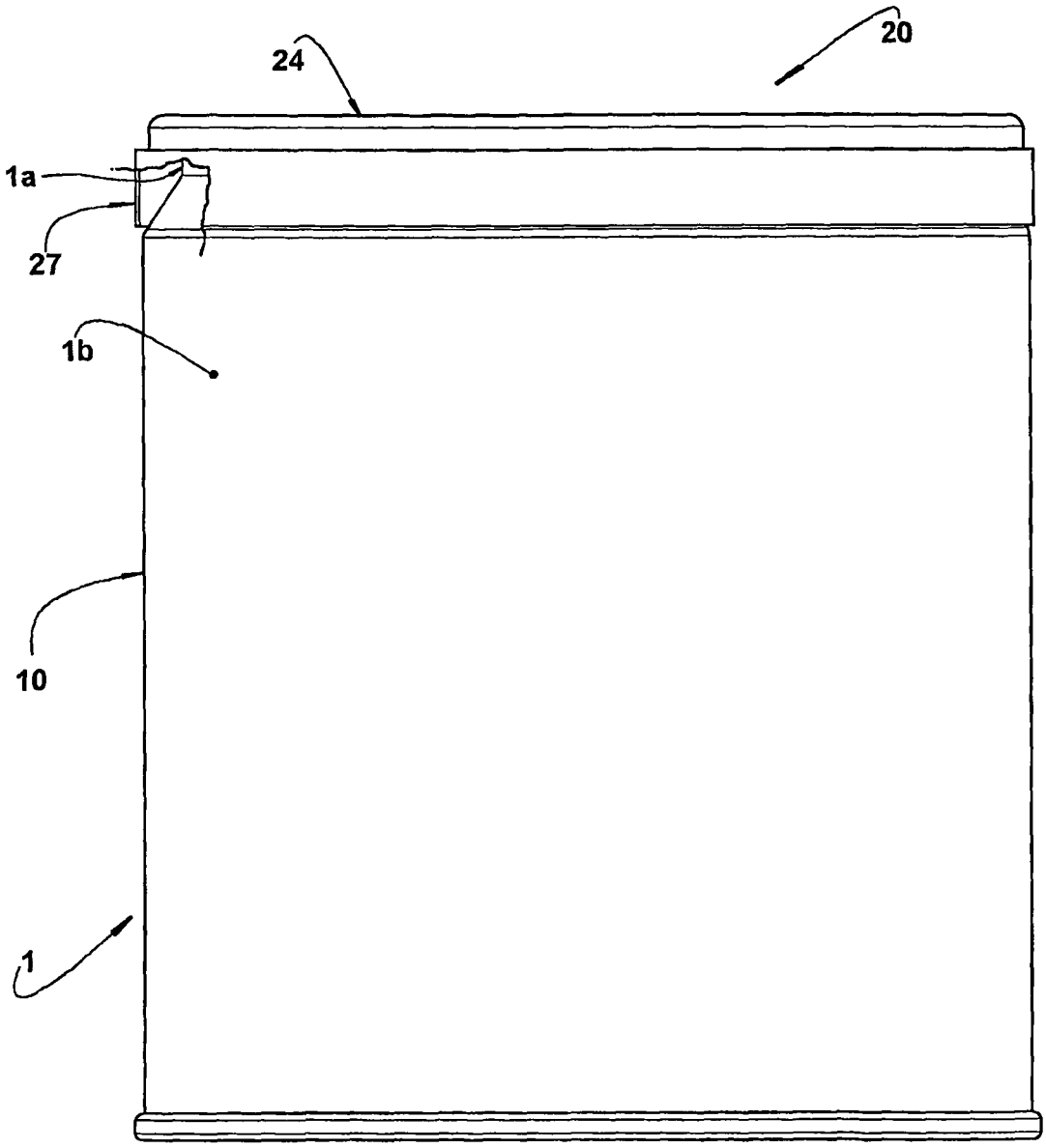
FIG. 1 represents a partially sectioned side elevation view of a can closed by an upper lid and incorporating the closure arrangement object of the present invention.
Figure 2:
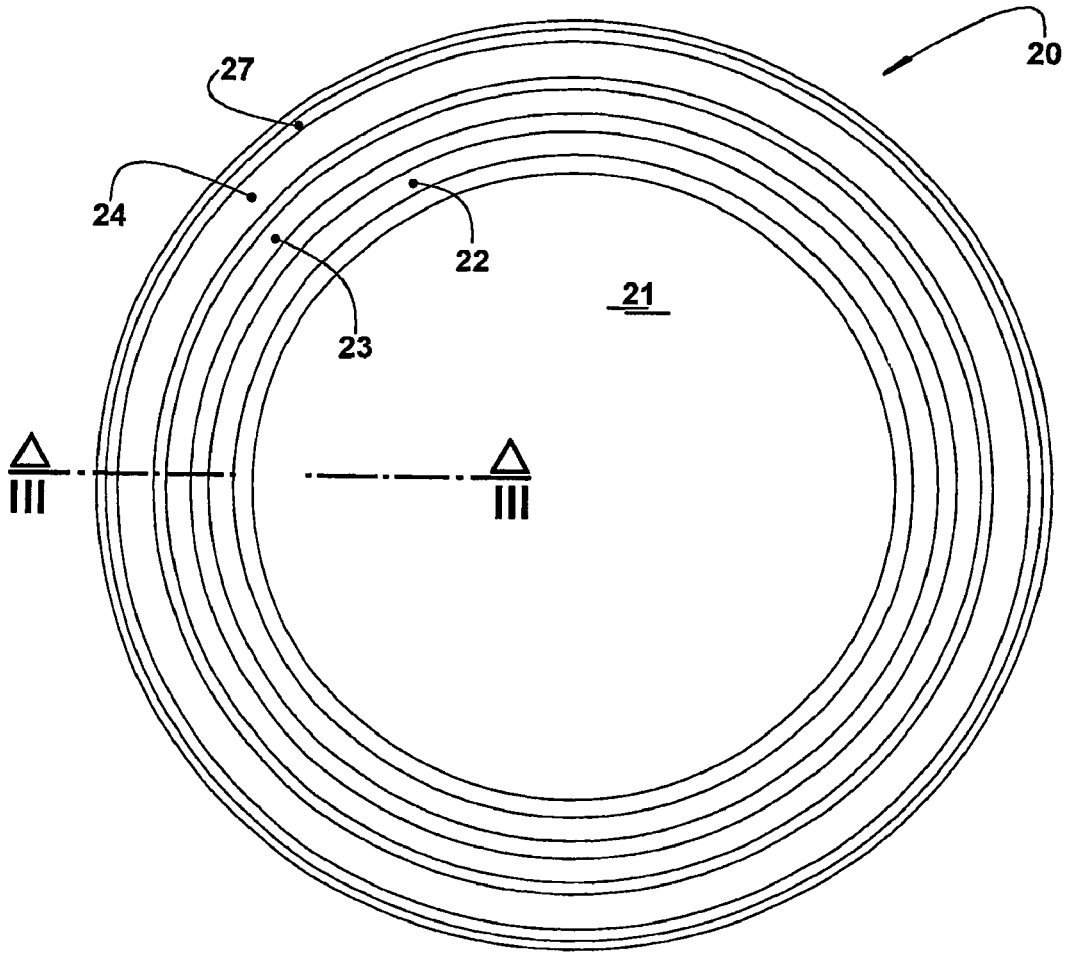
FIG. 2 represents a top plan view of the assembly illustrated in FIG. 1.

As already mentioned and illustrated in the drawings, the present closure arrangement is applied to cans of the type which comprises a tubular body 1, whose side wall 10, formed in metallic sheet, presents an upper edge 10*a* which defines a seat for the seating and retention of a lid 20 constructed in plastic material, to be manually removed and repositioned over the can, closing it several times from the first opening thereof, to permit the progressive consumption of the stored product.

According to the invention, the upper edge 10*a* of the tubular body 1 comprises a peripheral annular flange 11 which projects radially outwardly from the tubular body 1 and which is internally incorporated to the latter, so as to carry, in a free outer edge, a continuous rib 12 which usually projects only upwardly from the peripheral annular flange 11 and which presents a cross-section contour comprising two opposite circle arc portions 12*a*, having their curvature centers disposed in a plane P orthogonal to the axis of the tubular body 1.

In the preferred illustrated construction, the peripheral annular flange 11 and the continuous rib 12 are formed in a single piece with the side wall 10 of the tubular body 1, being sufficient that the metallic sheet, which forms said side wall 10, be adequately deformed to allow the provision of the peripheral annular flange 11 and of the continuous rib 12. In this case, the continuous rib 12 presents a tubular shape obtained by bending the metallic sheet of the side wall 10 of the tubular body 1, said continuous rib 12 preferably presenting a circular contour coinciding with that of the two circle arc portions 12*a*.

As illustrated, the continuous rib 12 presents a positioning tangent to the peripheral annular flange 11, being thus positioned immediately above the plane of the latter, allowing a certain axial distance to be defined between the plane of the peripheral annular flange 11 and a plane superiorly tangenting the whole circumferential extension of the continuous rib 12. Further according to the invention, the lid 20 is inferiorly provided with a continuous circumferential groove 24 which comprises an upper annular wall portion 24*a* configured to be seated onto the continuous rib 12 of the tubular body 1, and inner and outer wall portions 24*b* and 24*c* to be seated, by elastic deformation of the continuous rib 12 and/or of the lid 20, against the respective circle arc portions 12*a* of the continuous rib 12, both above and below the plane P, so as to axially lock the lid 20 in the tubular body 10.

The present closure arrangement further comprises a sealing annular gasket 30, carried by the peripheral annular flange 11 or by the lid 20, the annular gasket 30 being pressed by the other of said parts upon the closure of the lid.

In the illustrated construction, the lid 20 comprises, in a single piece and molded in adequate plastic material, a median wall 21 dimensioned to practically cover the open upper region of the tubular body 1 a peripheral wall 22, inferiorly incorporated to the median wall 21 and which superiorly incorporates an annular wall 23 projecting radially outwardly and under which is provided the continuous circumferential groove 24.

Figure 3:
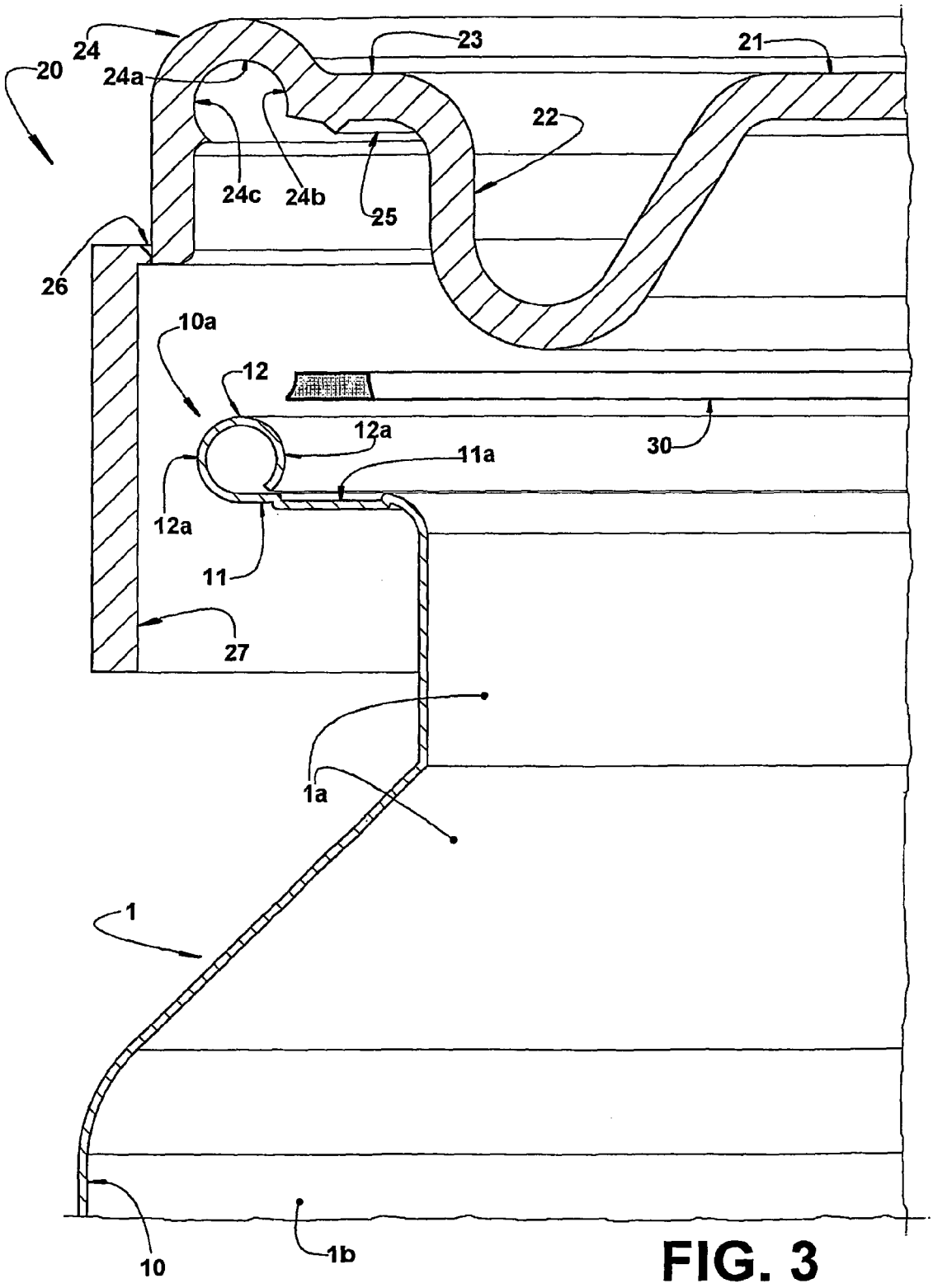
FIG. 3 represents a partial diametrical vertical sectional view of the lid, of the gasket and of the upper portion of the tubular body, in an exploded condition, said section taken according to the line III-III in FIG. 2.
Figure 3A:
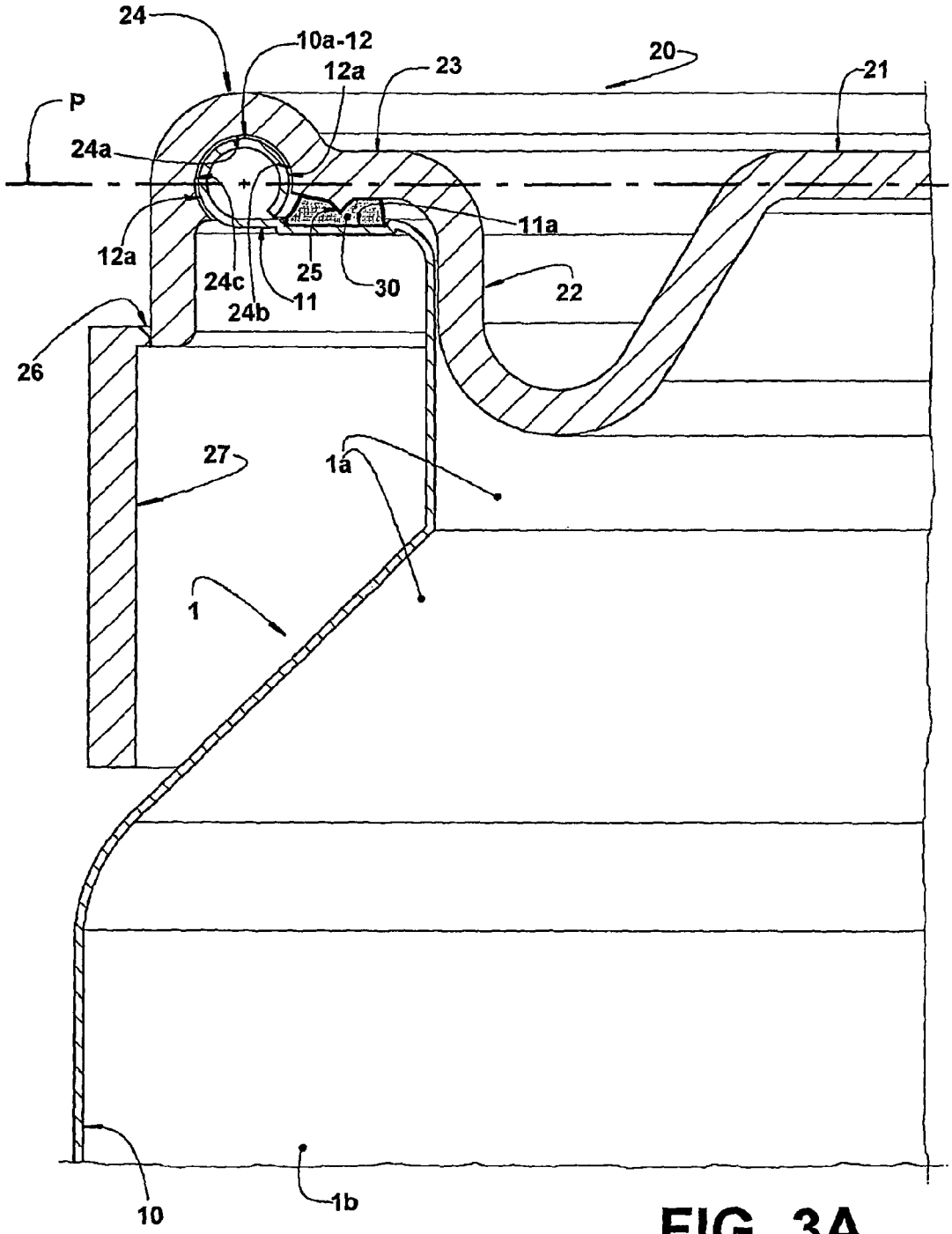
FIG. 3A represents a view similar to the view shown in FIG. 3, but with the lid in an assembled condition, mounted on the tubular body.

In the construction illustrated in FIGS. 3 and 3A, the annular gasket 30 is carried by the peripheral annular flange 11, said annular gasket 30 being glued or otherwise attached to the peripheral annular flange 11. It should be understood that the peripheral annular flange 11 may present a circumferential channel 11*a*, in low relief and which is dimensioned to receive and lodge a base portion of the annular gasket 30, facilitating the provision of said gasket over the peripheral annular flange 11, particularly in the cases in which the gasket is obtained in molded material, such as plastisol.

As further illustrated in FIGS. 3 and 3A, the annular wall 23 of the lid 20 can inferiorly incorporate, in a single piece, at least one continuous rib 25, dimensioned and configured to be pressed against the annular gasket 30 upon closing the lid 20, increasing even more the tightness degree in the lid 20/annular gasket 30 mutual seating.

Figure 4:
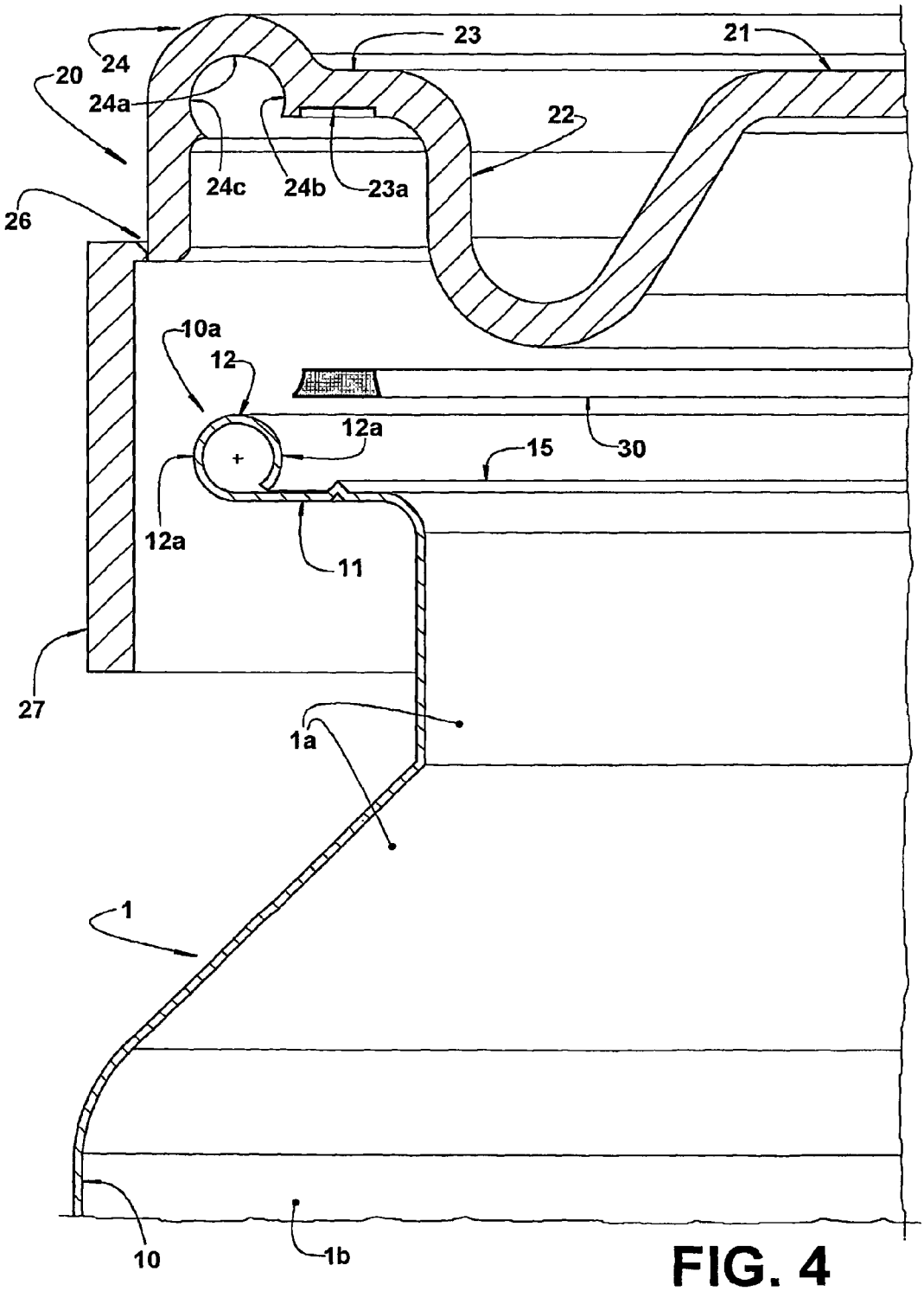
FIGS. 4 and 4A represent views similar to those shown in FIGS. 3 and 3A, respectively but illustrating another possible construction for assembling the annular gasket in the can lid.
Figure 4A:
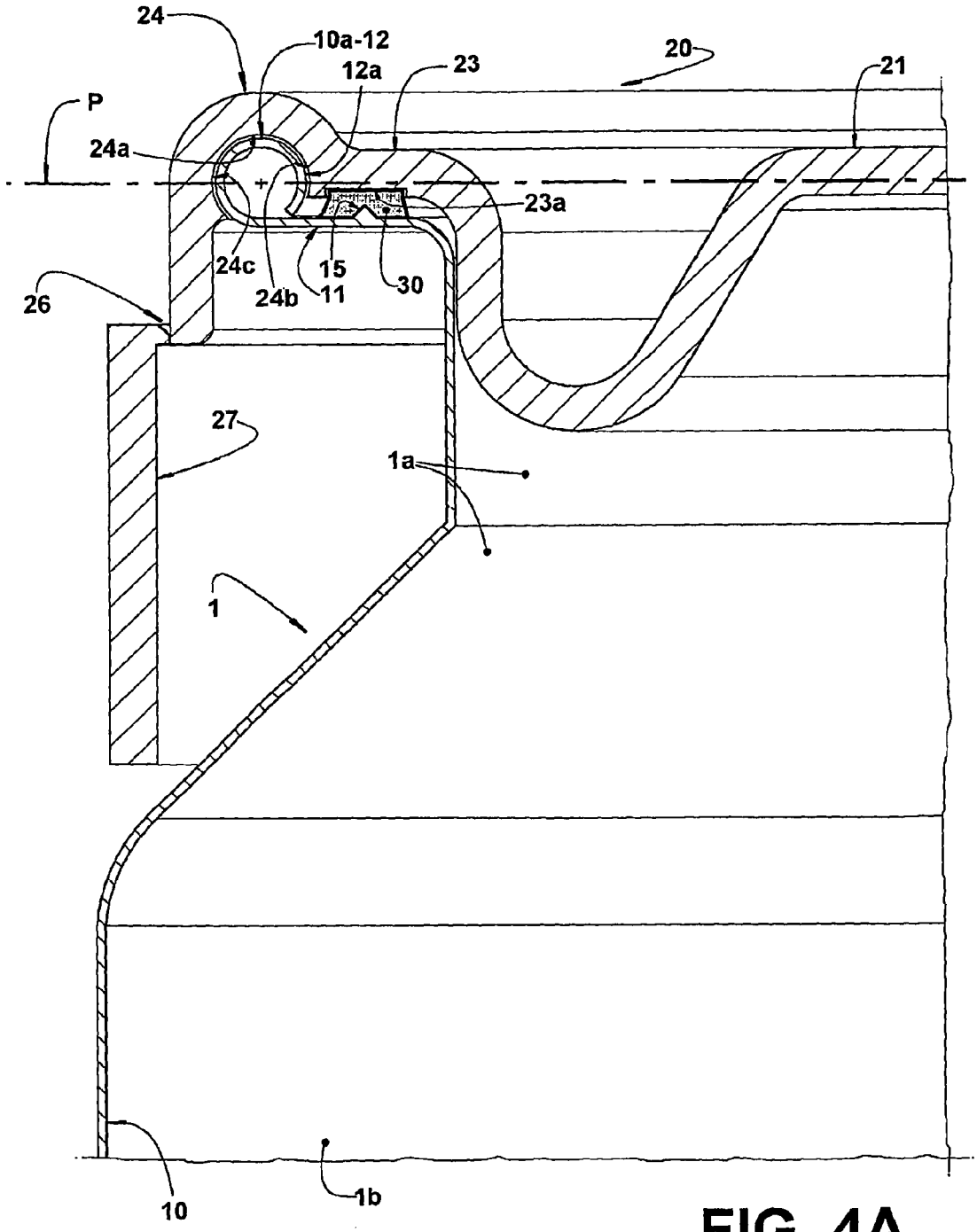

In another possible embodiment of the invention illustrated in FIGS. 4 and 4A, the annular gasket 30 is attached under the annular wall 23 of the lid 20. In this exemplary construction, the peripheral annular flange 11 of the tubular body 1 may incorporate, superiorly, at least one continuous rib 15 to be pressed against the annular gasket 30, upon the closure of the lid 20, as illustrated in FIGS. 4 and 4A.

It should be understood that the annular wall 23 of the lid 20 can internally present, as illustrated in FIGS. 4 and 4A, a circumferential channel 23*a*, in low relief and which is dimensioned to receive and lodge a base portion of the gasket 30.

Further according to the construction illustrated in FIGS. 4 and 4A, the continuous rib 15 of the peripheral annular flange 11 can be obtained by deformation of the latter, during the operations of shaping the tubular body 1 for providing the peripheral annular flange 11 and the continuous rib 12.

As already mentioned, it is desirable to provide the present closure arrangement with an element capable to evidence the first opening of the lid, to guarantee the safety and inviolability of the stored product.

Thus, the annular wall 23 of the lid 20 may carry, peripherally and inferiorly and through a plurality of breakable bridges 26, a seal strip 27, usually in the form of a cylindrical skirt pending from the lid 20.

In order to prevent the seal strip 27 from being submitted to undesired impacts with other objects or similar seal strips during shipping and handling operations of the closed can, the tubular body 1 preferably presents an upper portion 1*a* having a cross-section contour that is reduced in relation to the contour of a remaining portion 1*b* of said tubular body 1, so that the axial projection of the outer contour of the lid 20 remains internal to the contour of said remaining portion 1*b* of the tubular body 1. Aiming at making difficult the access to the region of the continuous rib 12, of a tool in the form of an elongated lever and, thus, the violation of the can content by lifting the lid without rupturing the breakable bridges 26 of the seal strip 27, the height of the upper portion 1*a* of the tubular body 1 is only slightly superior to the axial distance between the lower edge of the seal strip 27 and the upper edge 10*a* of the side wall 10 of the tubular body 1.

With the constructive arrangement of the tubular body 1 described above, the lower edge of the seal strip 27 is positioned adjacently to the side wall 10 of the tubular body 1, making impractible for a tool, a lever or any metallic rod to be introduced in the annular gap existing between the seal strip and the tubular body 1, for reaching the seating and retention region of the lid, in order to deform said region, sufficient to axially unlock the lid, without damaging the seal strip and its breakable bridges 26.

While only two constructive forms for the present closure arrangement have been illustrated herein, it should be understood that alterations can be made in the form and arrangement of the components, without departing from the constructive concept defined in the claims that accompany the present specification.

The invention claimed is:

1. A closure arrangement for cans and pots of the type having a tubular body in metallic sheet and having a side wall presenting an upper edge which defines a seat for the seating and retention of a lid made of plastic material and to be manually removed, wherein the upper edge of the side wall comprises a peripheral annular flange projecting radially outwardly from the tubular body, being internally incorporated to the latter and carrying, in a free outer edge, a continuous rib presenting a cross-section with a contour tangent to and projecting upwardly from the peripheral annular flange and which presents a cross-section contour comprising two opposite circle arc portions with curvature centers disposed in the same plane (P) orthogonal to the axis of the tubular body, the lid being inferiorly provided with a continuous circumferential groove which comprises an upper annular wall portion, and an inner wall portion and an outer wall portion to be seated, by elastic deformation of at least one of the parts of continuous rib and lid, against the respective circle arc portions of the continuous rib, above and below the plane, so as to axially lock the lid in the tubular body, said arrangement further comprising an annular gasket carried by one of the parts of peripheral annular flange and lid and which is pressed by the other of said parts upon closing the lid.

2. The arrangement, as set forth in claim 1, wherein the continuous rib presents a cross-section with a circular contour coincident with that of the two circle arc portions.

3. The arrangement, as set forth in claim 1, wherein the peripheral annular flange and the continuous rib are formed in a single piece with the side wall of the tubular body.

4. The arrangement, as set forth in claim 1, wherein the peripheral annular flange of the side wall of the tubular body is provided with a circumferential channel in low relief and which is dimensioned to receive and lodge a base portion of the gasket.

5. The arrangement, as set forth in claim 1, wherein the lid comprises, in a single piece, a median wall, a peripheral wall inferiorly incorporated to the median wall and superiorly incorporating an annular wall under which is provided the continuous circumferential groove.

6. The arrangement, as set forth in claim 5, wherein the annular wall of the lid is internally provided with a circumferential channel in low relief and which is dimensioned to receive and lodge a base portion of the gasket.

7. The arrangement, as set forth in claim 5, wherein the annular gasket is carried by the peripheral annular flange, the annular wall of the lid inferiorly incorporating at least one continuous rib to be pressed against the annular gasket upon the closure of the lid.

8. The arrangement, as set forth in claim 5, wherein the annular wall of the lid carries, peripherally and inferiorly and through a plurality of breakable bridges, a seal strip in the form of a cylindrical skirt pending from the lid.

9. The arrangement, as set forth in claim 8, wherein the tubular body presents an upper portion with a cross-section contour that is reduced in relation to the contour of a remaining portion of said tubular body, so that the axial projection of the outer contour of the lid is internal to the contour of said remaining portion of the tubular body.

10. The arrangement, as set forth in claim 9, wherein the height of the upper portion of the tubular body is slightly superior to the axial distance between the lower edge of the seal strip and the upper edge of the tubular body.

11. The arrangement, as set forth in claim 1, wherein the annular gasket is attached under the annular wall of the lid, the peripheral annular flange of the tubular body superiorly incorporating at least one continuous rib to be pressed against the annular gasket upon the closure of the lid.

12. The arrangement, as set forth in claim 11, wherein the continuous rib of the peripheral annular flange is obtained by deformation of the latter.

* * * * *